US006938389B2

(12) United States Patent
Fisher

(10) Patent No.: US 6,938,389 B2
(45) Date of Patent: Sep. 6, 2005

(54) ROLL FORMED STAPLE-IN AWNING FRAME AND METHOD

(75) Inventor: Larry M. Fisher, Marietta, GA (US)

(73) Assignee: Steel Stitch Corporation, Kennesaw, GA (US)

( * ) Notice: Subject to any disclaimer, the term of this patent is extended or adjusted under 35 U.S.C. 154(b) by 0 days.

(21) Appl. No.: 10/263,219

(22) Filed: Oct. 2, 2002

(65) Prior Publication Data

US 2003/0061782 A1 Apr. 3, 2003

Related U.S. Application Data

(60) Provisional application No. 60/326,914, filed on Oct. 3, 2001.

(51) Int. Cl.[7] ..... E06B 3/663; E04C 3/30

(52) U.S. Cl. ..... 52/720.1; 52/732.2; 52/730.1; 52/730.4; 52/74

(58) Field of Search ..... 52/720.1, 732.2, 52/737.6, 738.1, 730.1, 730.4, 73, 74, 730.5, 731.2, 731.3, 732.1; 428/358

(56) References Cited

U.S. PATENT DOCUMENTS

| | | | | |
|---|---|---|---|---|
| 2,287,667 A | | 6/1942 | Brown | |
| 2,834,412 A | | 5/1958 | Velke | |
| 3,357,681 A | * | 12/1967 | Souza, Jr. | 256/65.02 |
| 3,508,369 A | | 4/1970 | Tennison | |
| D218,295 S | | 8/1970 | MacLellan et al. | |
| 3,559,357 A | | 2/1971 | Lowe | |
| 3,834,104 A | | 9/1974 | Dunn et al. | |
| 4,189,880 A | | 2/1980 | Ballin | |
| 4,193,235 A | | 3/1980 | Cucchiara | |
| 4,231,141 A | | 11/1980 | Derrick et al. | |
| 4,233,790 A | | 11/1980 | Meadows | |
| 4,272,073 A | | 6/1981 | Grosser et al. | |
| 4,690,192 A | | 9/1987 | Stilling | |
| 4,718,213 A | * | 1/1988 | Butterfield | 52/732.1 |
| 4,726,869 A | | 2/1988 | Matsui et al. | |
| 4,759,087 A | | 7/1988 | Zeilinger | |
| 4,817,655 A | | 4/1989 | Brooks | |
| 4,845,916 A | * | 7/1989 | Villard | 52/792.1 |
| 4,926,605 A | | 5/1990 | Milliken et al. | |
| D309,351 S | | 7/1990 | Patsy, Jr. | |
| 5,044,131 A | | 9/1991 | Fisher | |
| 5,172,743 A | | 12/1992 | Wallace et al. | |
| 5,209,029 A | | 5/1993 | Foerst | |
| 5,224,306 A | | 7/1993 | Cramer | |
| 5,237,785 A | | 8/1993 | Lukes | |

(Continued)

OTHER PUBLICATIONS

Steel Stitch—Awning, Canopy & Sign Supply Catalog—Jan., 1998.

Eastern Awning Systems, Inc.—Maxi Window Awning Brochure.

The William L. Bonnell Company, Inc., Newnan, GA—Brochure Apr. 11, 1988.

Steel Stitch System Represents the Future of Fabric Structure Design—10536/STE BuyLine 9416.

Breakthrough to The Next Century with the Power of Steel Stitch—Brochure.

Steel Stitch Corporation—Manufacturers of The Perfect Awning Frame—Apr., 1993—pp. 1–16.

*Primary Examiner*—Carl D. Friedman
*Assistant Examiner*—Basil Katcheves
(74) *Attorney, Agent, or Firm*—Womble Carlyle Sandridge & Rice, PLLC

(57) ABSTRACT

An improved roll formed staple-in awning frame member is disclosed as is a process for its fabrication. The body (21) of a frame member and the staple deck member (11) thereof are roll formed separately along parallel roll forming lines. The staple deck member (11) is then progressively inserted into the body (21) and the two are secured together by a crimping, welding, or other appropriate operation. The frame member is then finally shaped and formed and cut to size in a continuous roll forming and fabrication operation.

2 Claims, 13 Drawing Sheets

U.S. PATENT DOCUMENTS 5,242,004 A 9/1993 Stilling
5,259,323 A 11/1993 Koch et al.
5,291,705 A 3/1994 Dickerson
5,469,672 A 11/1995 Fisher
5,514,432 A * 5/1996 Lisec ..... 428/35.8
5,555,695 A 9/1996 Patsy, Jr.
5,577,352 A 11/1996 Fisher
5,713,108 A * 2/1998 Solomon et al. ..... 24/30.5 R
5,791,115 A * 8/1998 Nicolai et al. ..... 52/730.4
5,794,400 A * 8/1998 Fisher et al. ..... 52/731.2
5,906,078 A * 5/1999 Cramer ..... 52/222
6,321,397 B1 * 11/2001 Fogg et al. ..... 4/609

* cited by examiner

ROLL FORMED STAPLE-IN AWNING FRAME AND METHOD

REFERENCE TO RELATED APPLICATION

Priority is hereby claimed to the filing date of U.S. provisional patent application Ser. No. 60/326,914 filed on Oct. 3, 2001, the disclosure of which is incorporated herein by reference.

TECHNICAL FIELD

This invention relates generally to fabric awnings and more particularly to staple-in metal frames and frame components for such awnings.

BACKGROUND

So-called staple-in awning frames, across which canvas or other cloth material is stretched to form an awning, have become popular in recent years. In general, a staple-in awning frame is fabricated with metal ribs that form the skeleton of the awning. At least some of the ribs, which generally are square or rectangular in shape, have a slot along their outside edges and a staple deck recessed within the slot. When a cloth material is stretched over the frame, it is tucked into the slots of the frame ribs and staples are driven through the cloth and through the staple deck to secure the material to the ribs. Once the cloth material is attached in this way, lengths of plastic or rubberized filler strips are snapped into the slots to hide the staples, cover the slots, and form an aesthetically pleasing appearance. This method of fabricating cloth awnings has proven superior to old tie-on and other methods.

In the past, awning frame members for staple-in awnings generally have been extruded from aluminum with the body, slot, and staple deck of the frame member being extruded as a unitary piece of extruded aluminum. While such extrusions have been successful, aluminum extrusion generally is an expensive and maintenance intensive manufacturing process. Furthermore, the softness of aluminum can lead to deformation and even collapse of the frame members in some cases, particularly where they are bent into an arc for use in rounded awning designs. Finally, the welding of aluminum requires special helium arc welding equipment and special skill, which is undesirable for some awning manufacturers. Thus, a need exists for an improved staple-in awning frame member that is less expensive to manufacture, less prone to collapse and deformation when bent, easier to weld and otherwise work with when building an awning frame, and generally improved over prior art extruded aluminum frame members. It is to the provision of such an awning frame member and to a methodology for its fabrication using roll forming techniques that the present invention is primarily directed.

SUMMARY OF THE INVENTION

Briefly described, the present invention is an improved staple-in awning frame member formed from two roll formed strips of metal. One of the strips of metal forms the generally square or rectangular body of the frame member with a slot along one side and the other forms a staple deck member that is nested and secured within the body member recessed within the slot to form the staple deck of the frame member. Preferably, the body and staple deck member are each formed of galvanized steel, although other metals such as aluminum, copper, or the like may be used for either or both. A method of roll form fabrication of the awning frame member also is disclosed and is part of the invention. During fabrication, strips of metal that will become the body and staple deck member are progressively roll formed, preferably along parallel paths, into generally U-shaped or C-shaped configurations as they advance through a roll forming machine. When the strips are almost fully formed, but still somewhat splayed, the strip that will become the staple deck member is progressively moved into the slot of the body. The combined body and staple deck member are then progressively bent inwardly to form the generally square shape of the frame member and the staple deck member is securely fastened to the body. The staple deck may be secured to the body with spot welds, through punches, or other means but, in the illustrated and preferred embodiment, is secured by having an inner flange of the body along the edges of the slot bent over the upper edge portions of the staple deck. With the assembly thus formed, a final step includes impacting the sides of the frame member with substantial force to urge it into its final square shape. The resulting awning frame member resembles in some respects prior art extruded aluminum frame members and is used in a similar way to build awning frames. However, since it is formed in a continuous roll forming process rather than an aluminum extrusion process, it is substantially less expensive and less troublesome to manufacture. The resulting frame member preferably is made of steel rather than aluminum, and therefore is easier to weld and otherwise bend and work with than aluminum frame members. In addition, steel awning frame members have been demonstrated to be less susceptible to collapse when bent into an arc and generally form awning frames that are stronger and more rigid than aluminum frames. These and other features, objects, and advantages of the frame member and fabrication process of this invention will become more apparent upon review of the detailed description of the invention set forth below when taken in conjunction with the accompanying drawing figures, which are briefly described as follows.

DETAILED DESCRIPTION OF THE PREFERRED EMBODIMENTS

The preferred embodiment of the inventions disclosed herein will now be described with reference to the attached drawing figures. Since roll forming in general and the various roll forming stations illustrated in these drawings generally are self explanatory to one of skill in the art of roll forming, excessive description of roll forming techniques is not necessary and will not be provided here. Instead, reference to the drawings will be made primarily to illustrate the various steps of the method of this invention for roll forming the awning frame member of the invention.

Figure 1:
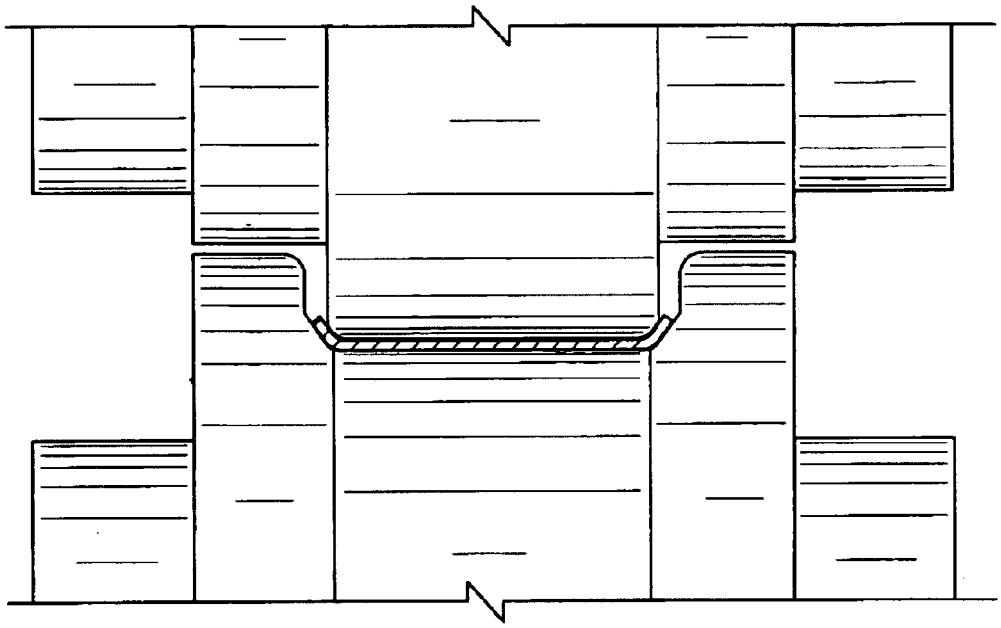
FIGS. 1 through 8 are end views relative to a strip of metal that illustrate the forming of the strip at successive stations of a roll forming machine in the fabrication of the staple deck member of this invention.
Figure 2:
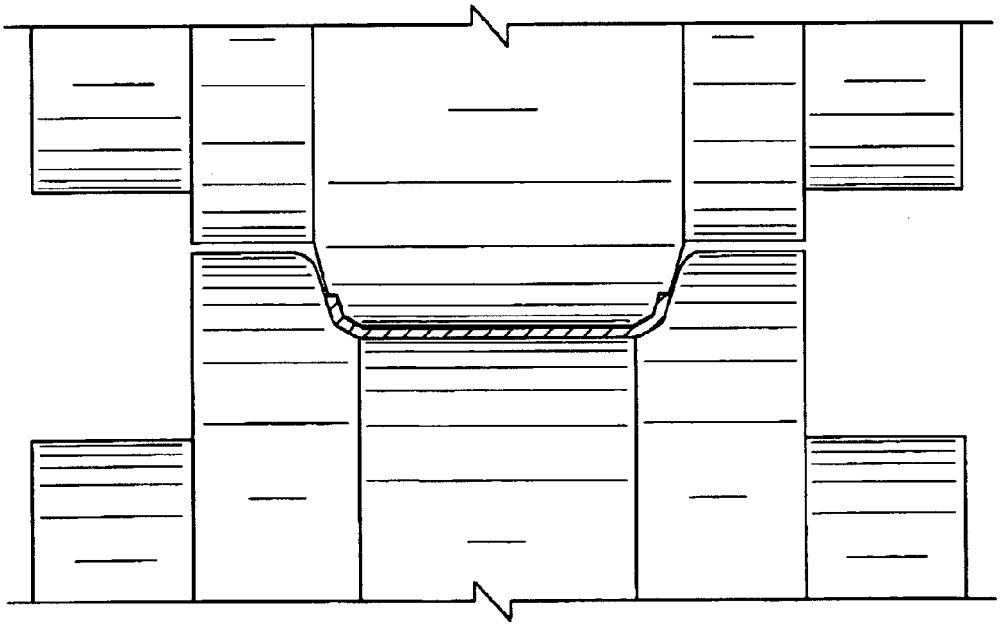
Figure 3:
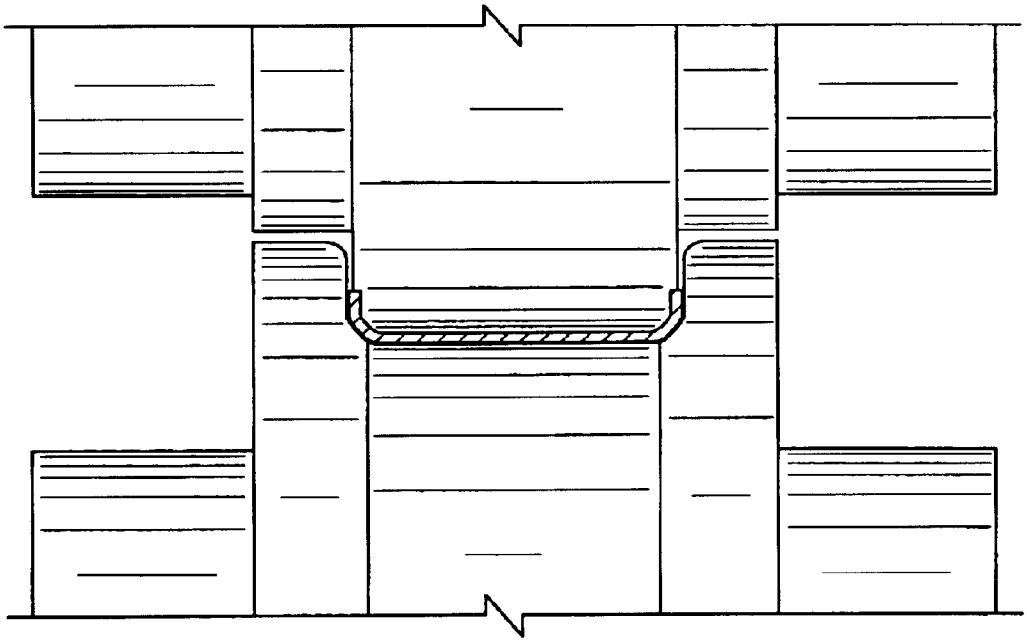
Figure 4:
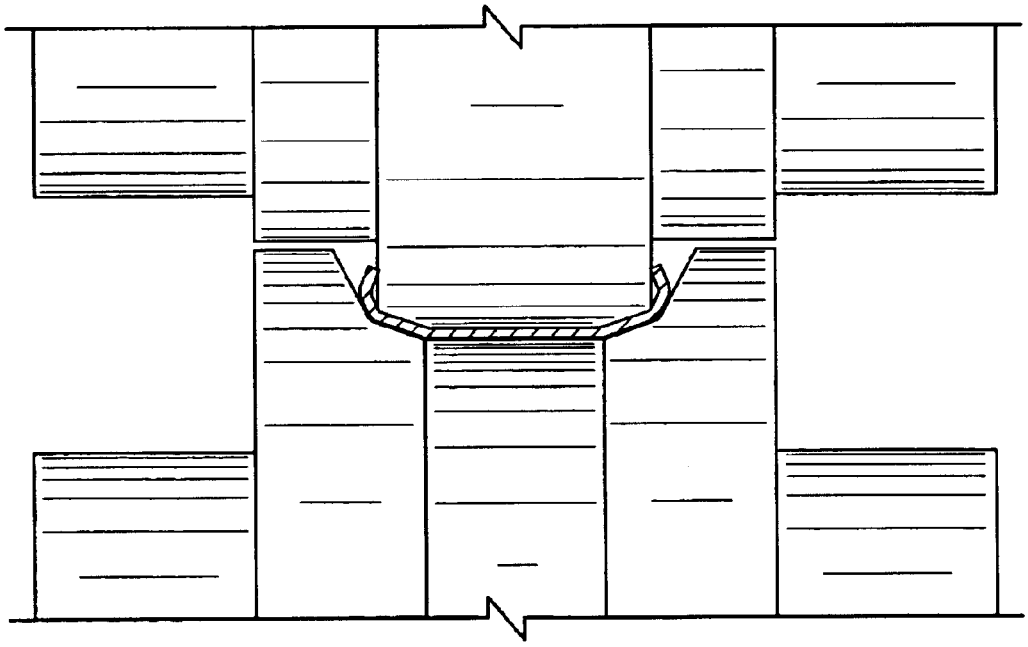
Figure 5:
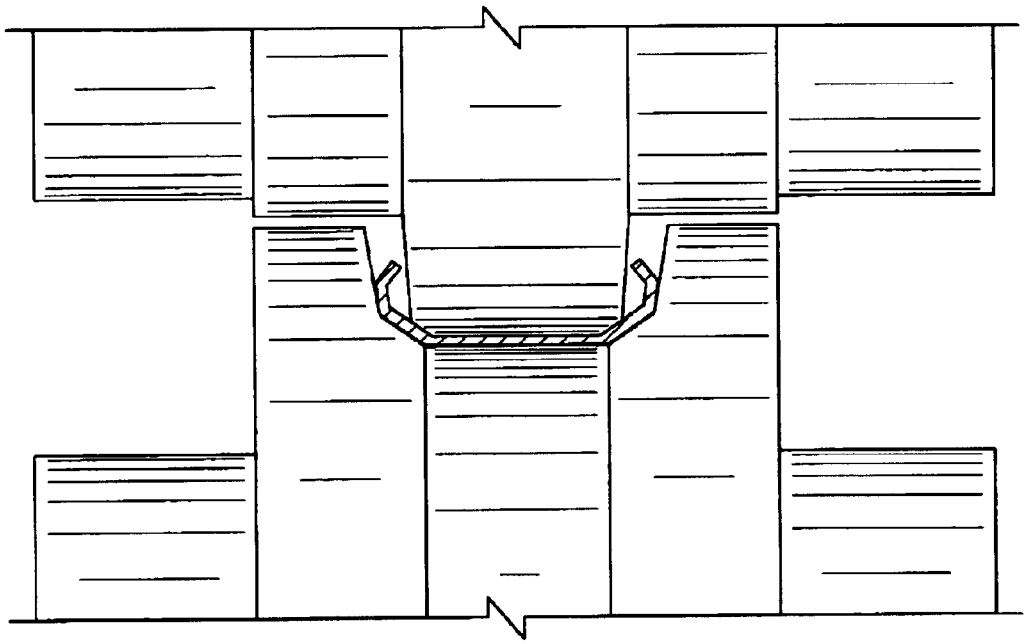
Figure 6:
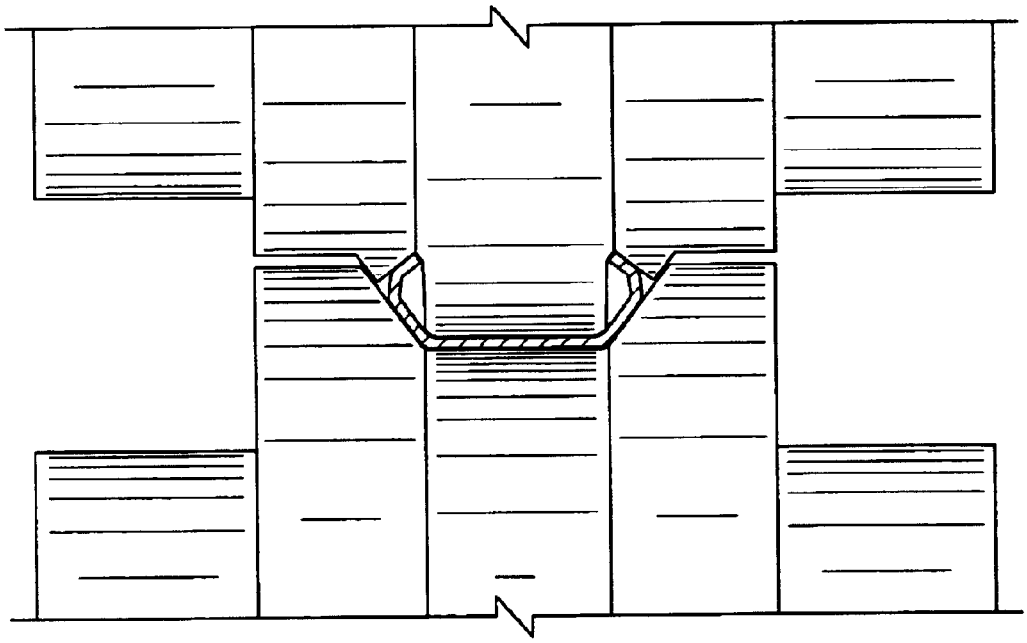
Figure 7:
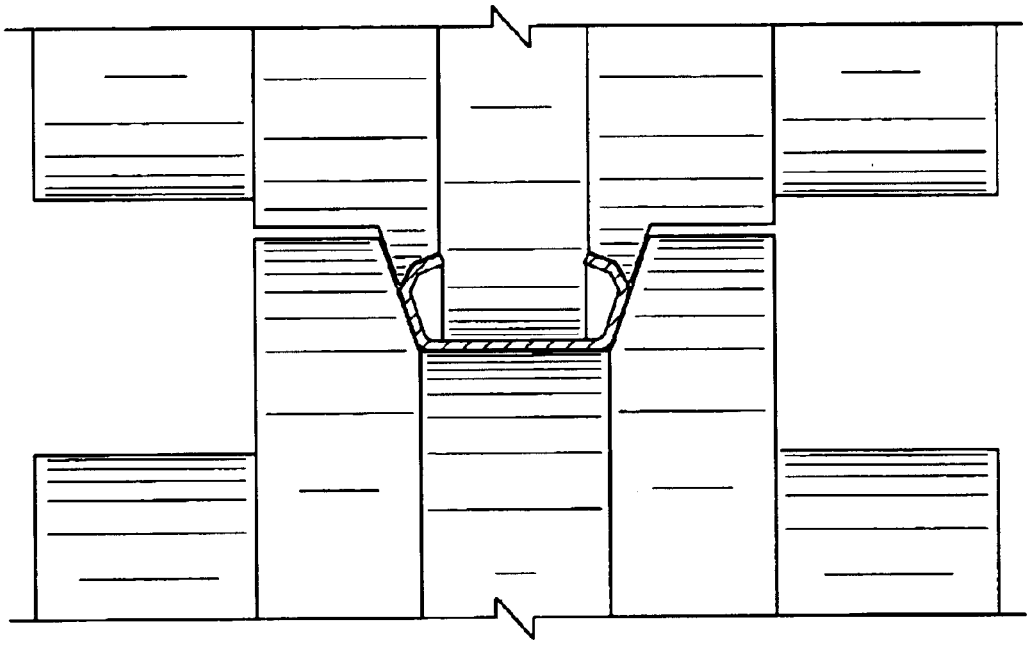
Figure 8:
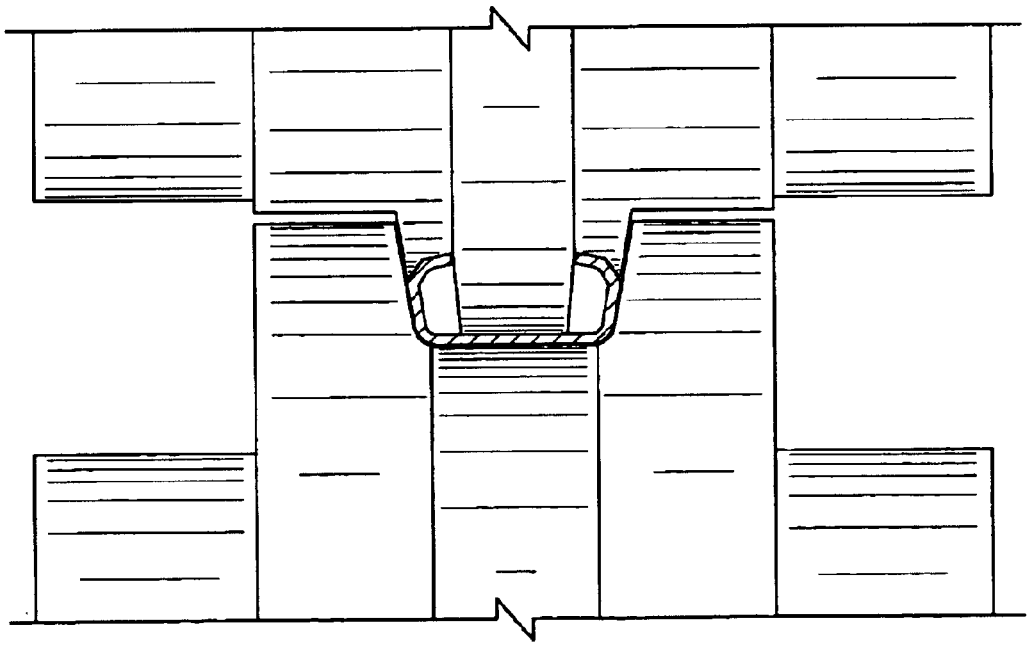
Figure 9:
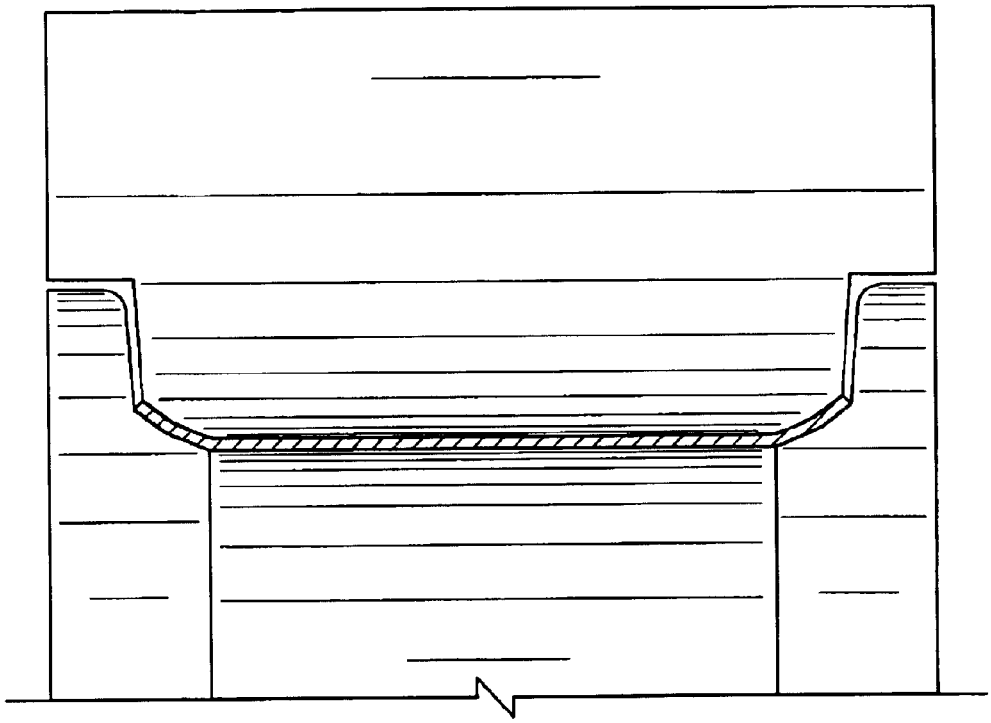
FIGS. 9 through 18 are end views relative to a strip of metal that illustrate the forming of the strip at successive stations of a roll forming machine in the fabrication of the body of the frame member according to this invention.
Figure 10:
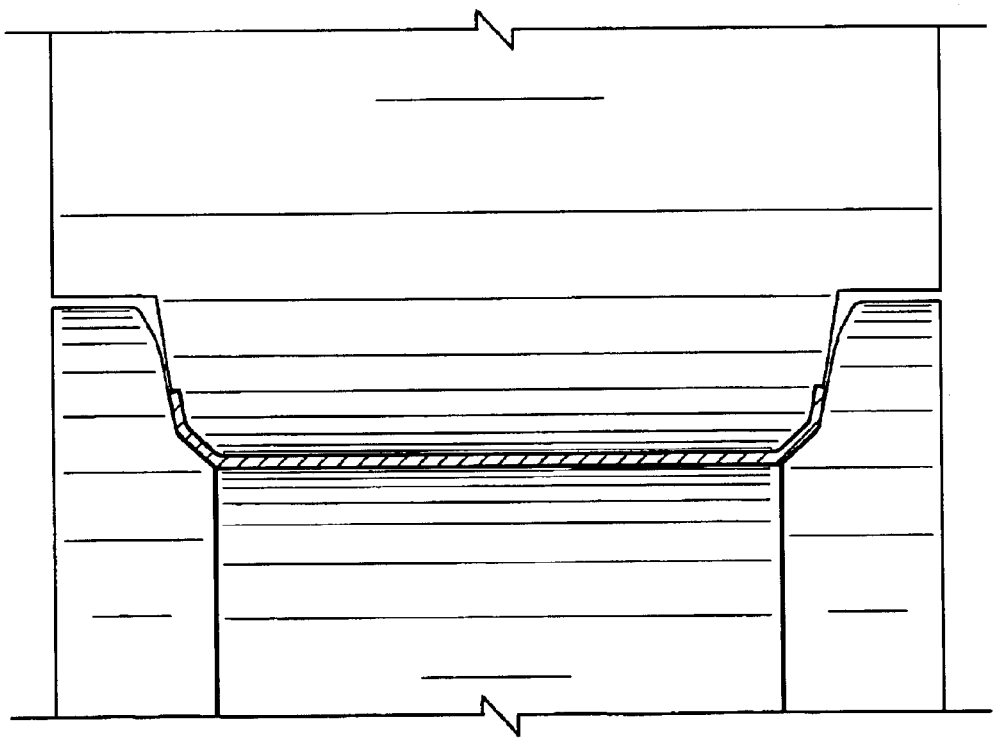
Figure 11:
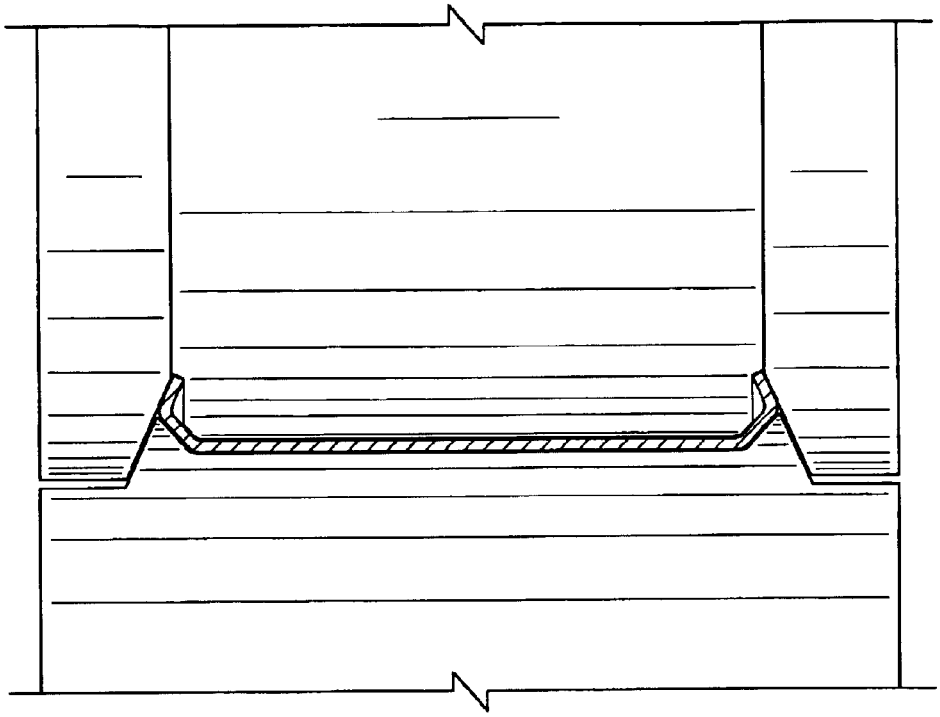
Figure 12:
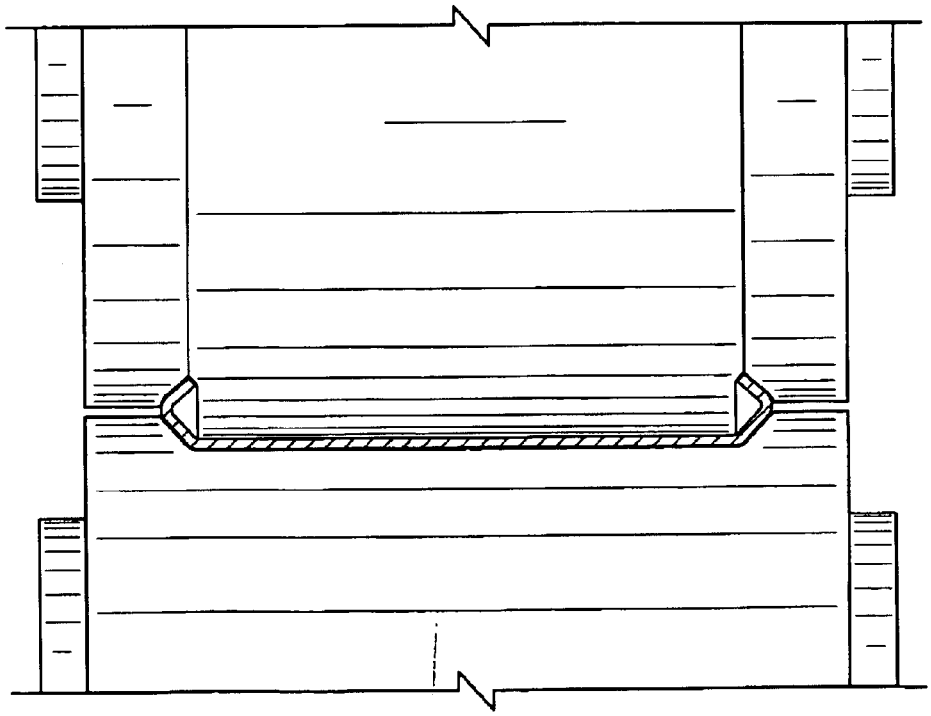
Figure 13:
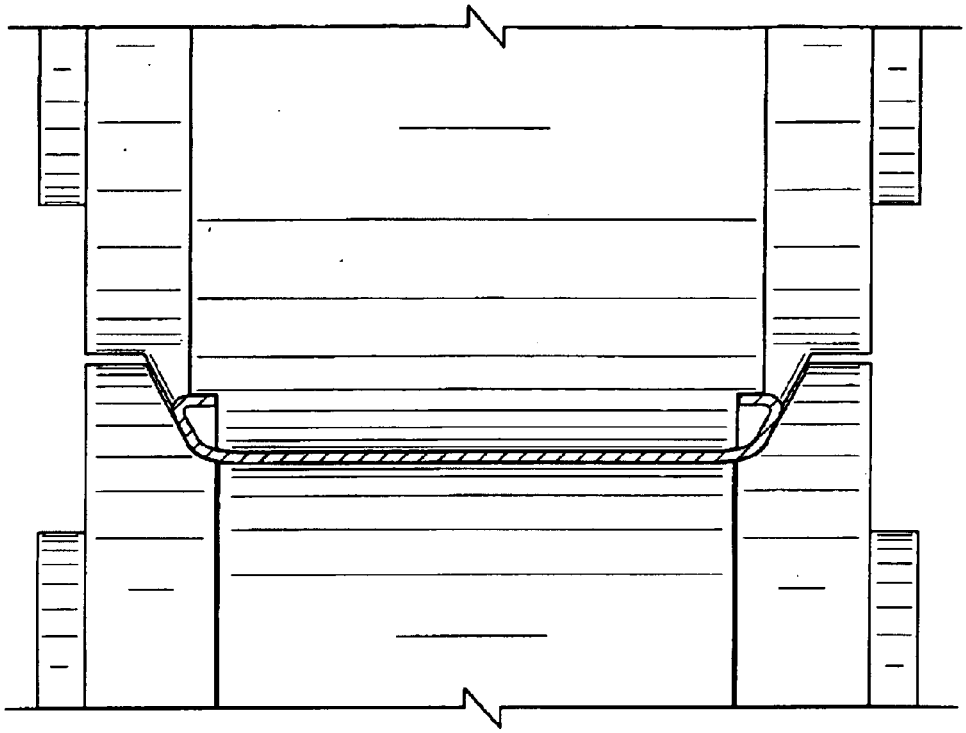
Figure 14:
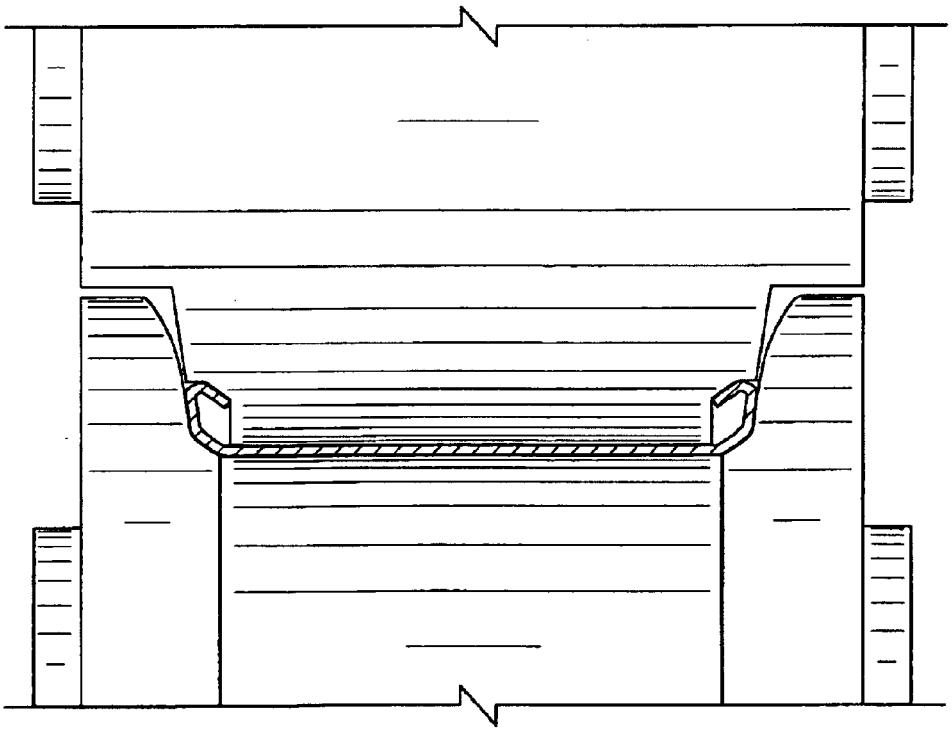
Figure 15:
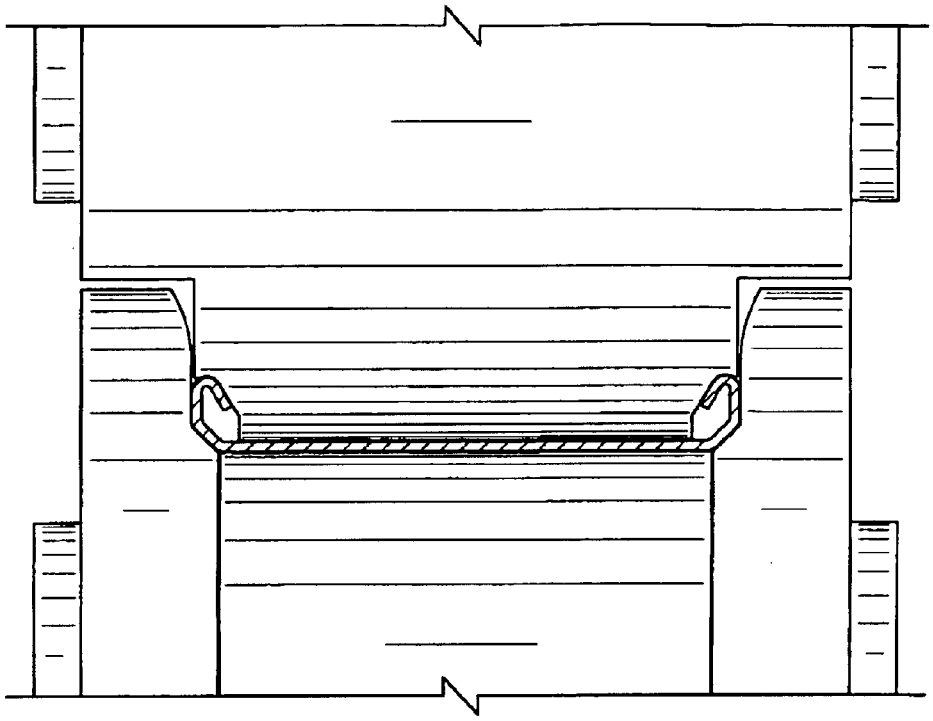
Figure 16:
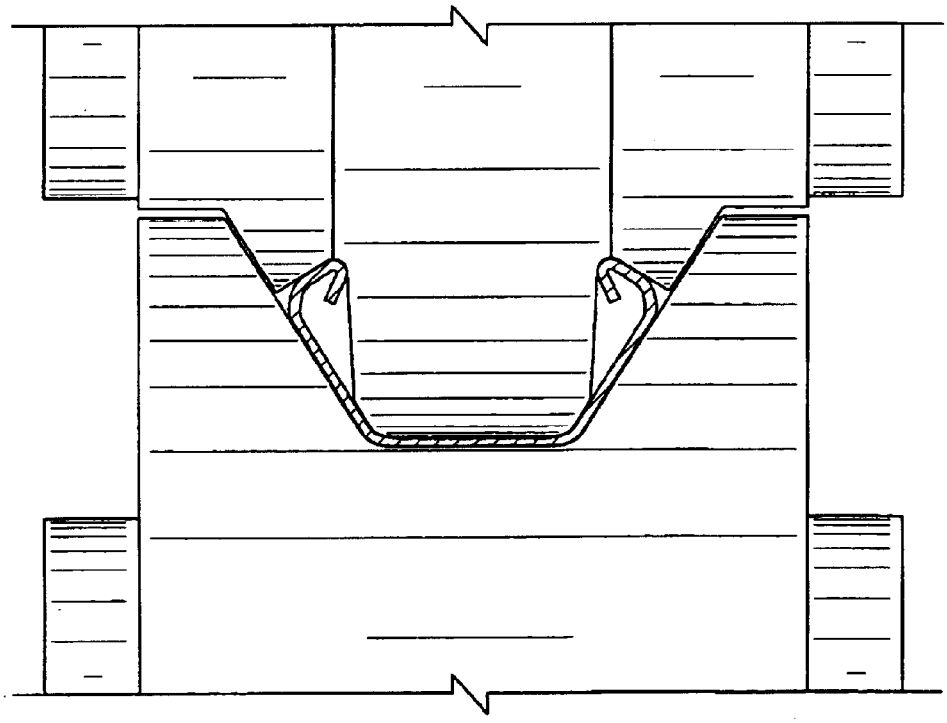
Figure 17:
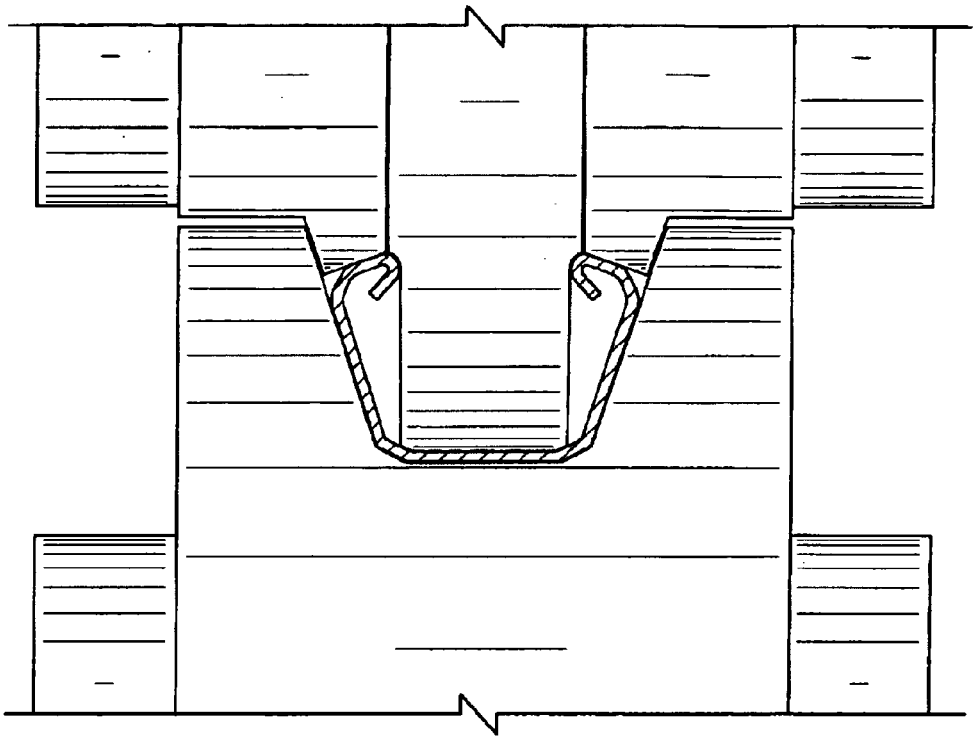

FIGS. 1 through 8 illustrate the progressive roll form shaping of an elongated strip of metal that will become the staple deck member of the finished frame member. In practice, the strip preferably is drawn from a roll and fed to the roll forming line at the upstream end thereof so that the roll forming process may be substantially continuous. Each successive figure of FIGS. 1 through 8 is an end view relative to the strip looking upstream toward a roll forming station that is one of a succession of roll forming stations along the roll forming line. The configurations of the top and bottom rollers at each station are illustrated, as is, in cross-section, the shape of the strip of metal as it passes between and is shaped by the rollers of the station. It can be seen from these figures that the strip is progressively roll formed into a generally U or inverted C-shape. The final shape of the strip after being roll formed is best illustrated in FIG. 8. After passing through the roll forming station of FIG. 8, the strip 11 has a deck 12, two opposed side walls 13 and 14, and a pair of generally inwardly extending tabs or edges 16 and 17 along its upper ends. Further, at this point, the strip has a somewhat open or splayed shape, for purposes described in more detail below. The metal from which the staple deck member is formed preferably is a metal that will accept staples from a pneumatic staple gun when attaching a cloth material to the finished frame member. For example, the metal can be aluminum or, more preferably, a relatively soft galvanized steel.

Figure 18:
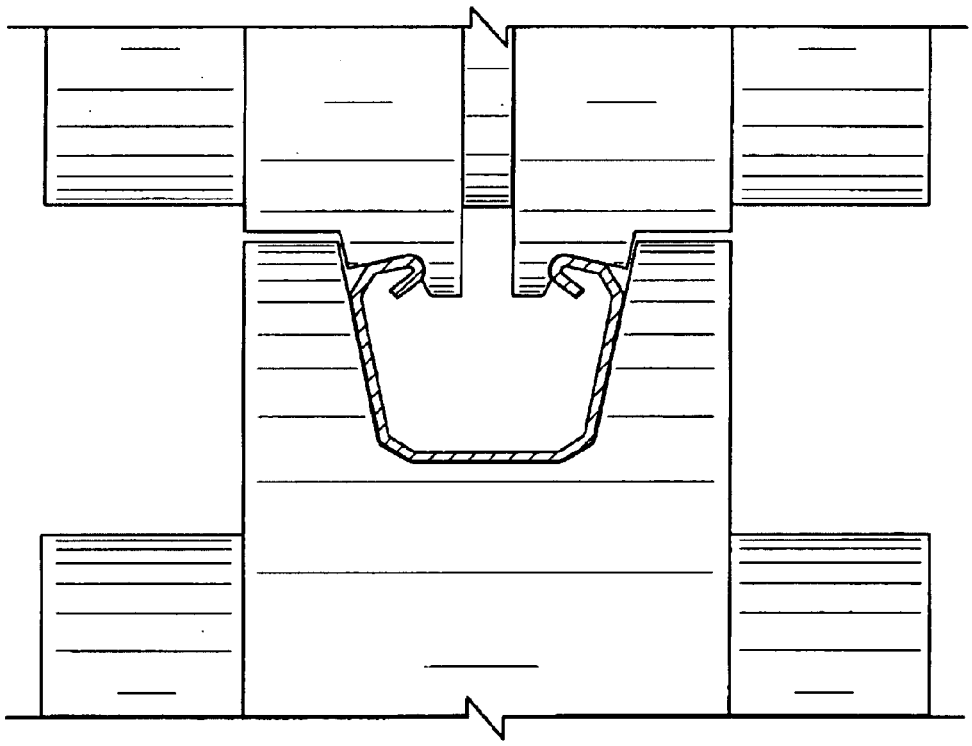

Similarly, FIGS. 9 through 18 illustrate the progressive roll forming of a strip of metal that will become the body of the fame member. In practice, the two strips of metal that will form the staple deck member and body respectively are roll formed simultaneously as the strips move along parallel roll forming paths in the roll forming machine. As with the staple deck, the shape of the body after passing through the set of rollers shown in FIG. 18 is a generally U or C-shape. The body 21 has a floor 22, two opposed sides 23 and 24, two inwardly projecting tabs 26 and 27, which define a slot between them for receiving cloth material and staples, and a pair of inner tangs 28 and 29 disposed beneath their respective tabs 26 and 27. Further, the corners 31 of the body are chamfered to provide enhanced strength to the body and the finished frame member. As with the staple deck, the body at the station illustrated in FIG. 18 of the roll forming process is somewhat open or splayed outwardly. Further, the spaces between the inner tangs 28 and 29 and the tabs 26 and 27 are open in order to receive the edges 16 and 17 of the staple deck, as described in more detail below.

Figure 19:
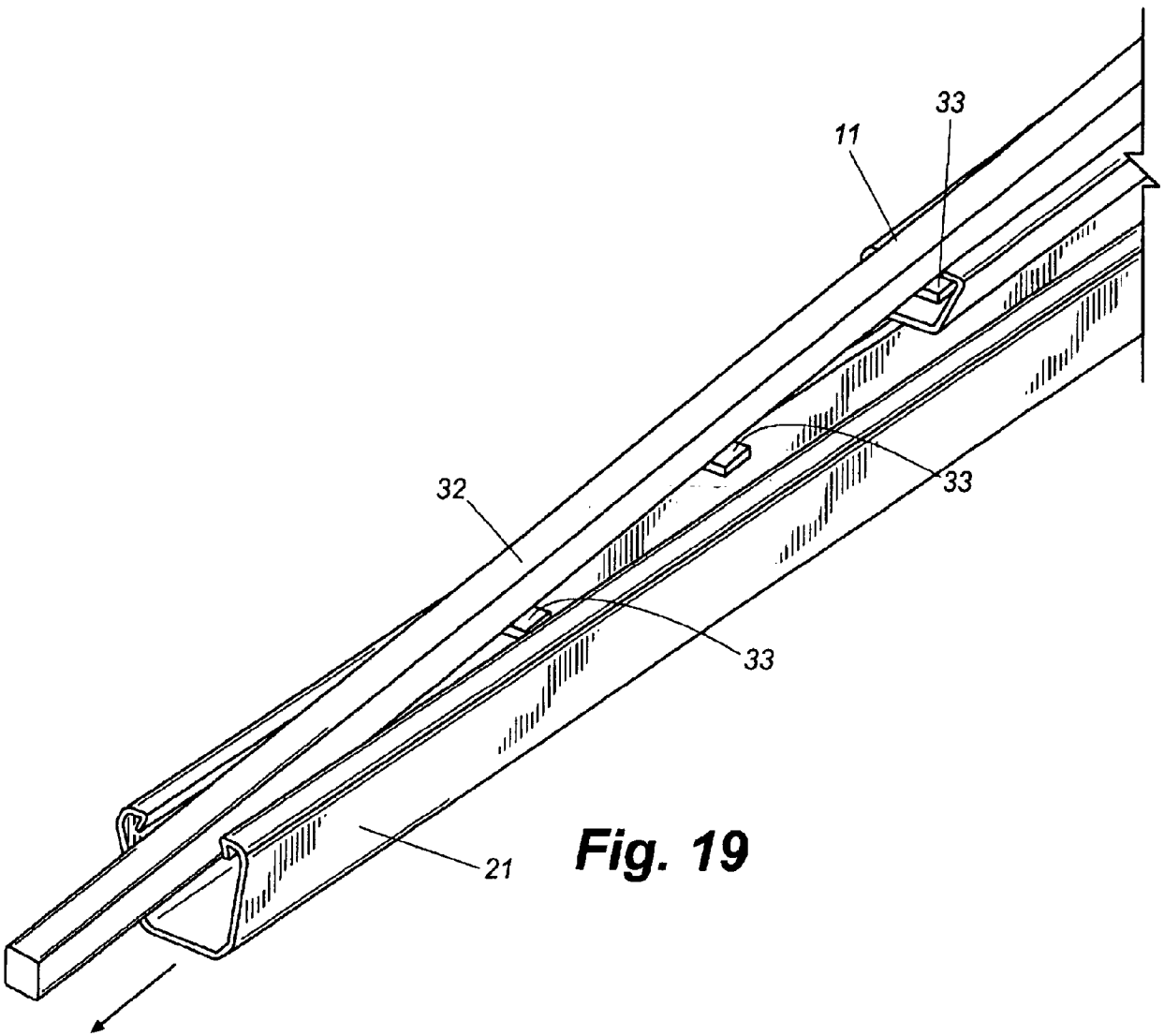
FIG. 19 is a perspective view illustrating the step of the process where the partially formed staple deck member is inserted into the partially formed body and is positioned for being secured therein in a subsequent step.

With the body and staple deck roll formed into the shapes shown in FIGS. 8 and 18, both are advanced along vertically parallel paths and the staple deck is progressively moved by a guide rail toward and into the body, as best illustrated in FIG. 19. More specifically a guide rail 32 has a series of guide blocks 33 attached to its bottom side and the rail 32 extends from an upper roll forming line where the staple deck member 11 is formed progressively into the inside of the body 21 through its open slot. The splayed shape of the body 21 insures that the slot opening is large enough to receive the staple deck as it is guided into the body on the guide rail.

Figure 20:
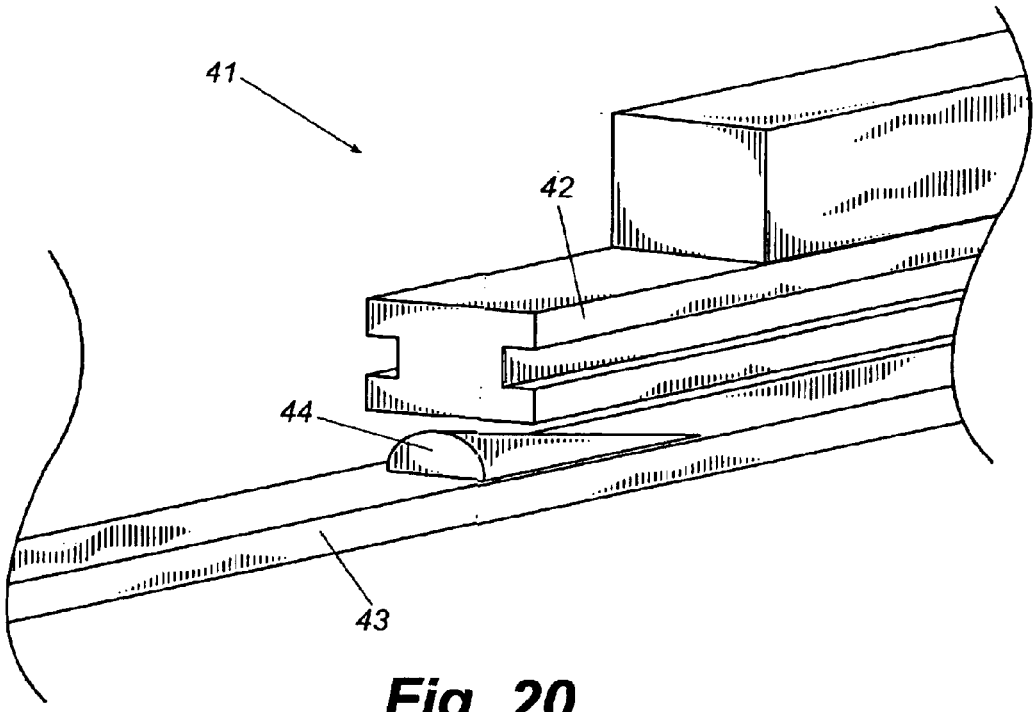
FIGS. 20 and 21 illustrate the positioning station where the staple deck, which is inserted into the body in FIG. 19, is properly positioned within the body prior to being secured therein.
Figure 21:
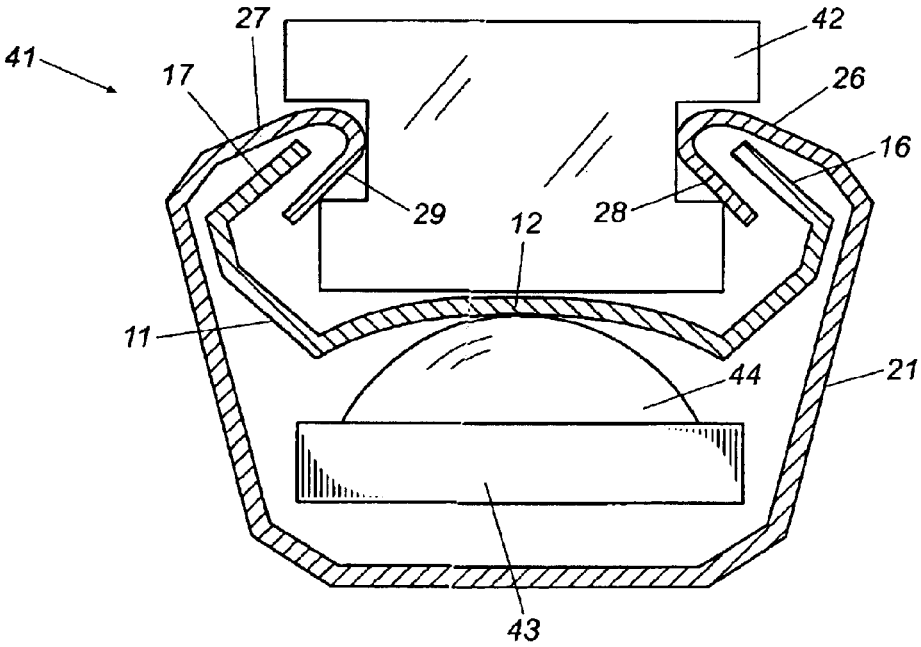

With the partially formed staple deck inserted in the partially formed body, the assembly is moved through a positioning station 41, which is illustrated in FIGS. 20 and 21. The positioning station 41 includes an upper guide block 42 shaped to align and center the body and the staple deck member relative to one another, and also includes a lower rail 43. An arcuate wedge-shaped pressure block 44 is mounted to the lower rail 43 beneath the upper guide block 42. As best illustrated in FIG. 21, as the body and staple deck move through the positioning station 41, the upper guide block centers the staple deck and body with respect to each other and the pressure block forces the staple deck member upwardly until its edges 16 and 17 move into and are received in the space between the upper tabs 26 and 27 of the body and the inner tangs 28 and 29 thereof. The pressure block also bows the deck of the staple deck member upwardly as shown so that when the assembly is bent inwardly to a square shape at downstream stations, the floor of the staple deck will tend to bend back to a substantially flat configuration. After passing the positioning station, the staple deck is in position to be secured within the body as described below.

Figure 22:
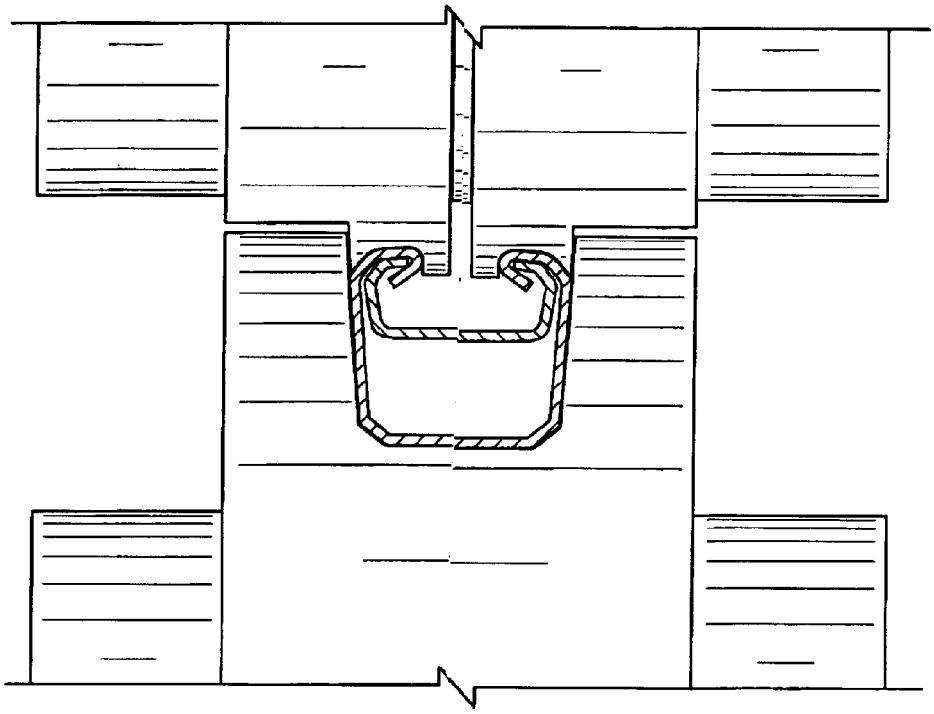
FIG. 22 illustrates the step of bending the body with inserted and positioned staple deck assembly toward a substantially square configuration subsequent to positioning the staple deck at the positioning station of FIGS. 20 and 21.
Figure 23:
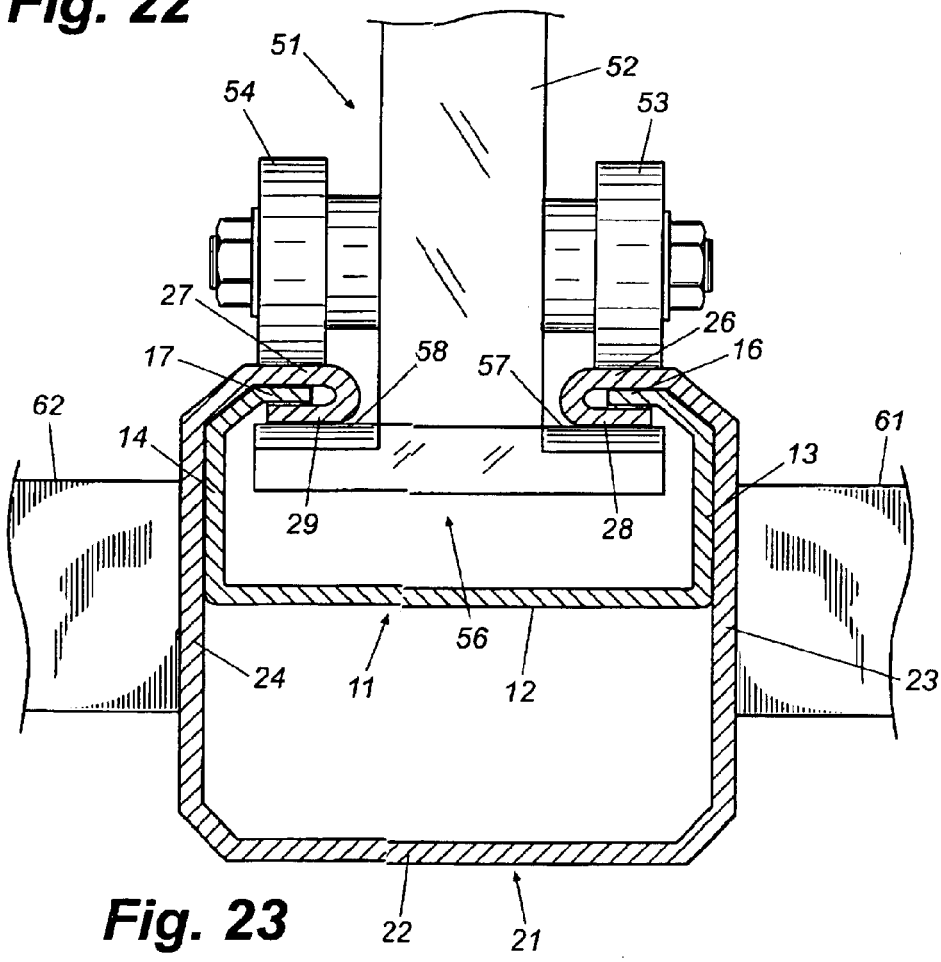
FIG. 23 illustrates the step of securing the staple deck member in the body by crimping the tangs of the body around the edges of the staple deck member using an anvil and crimping roller assembly.
Figure 24:
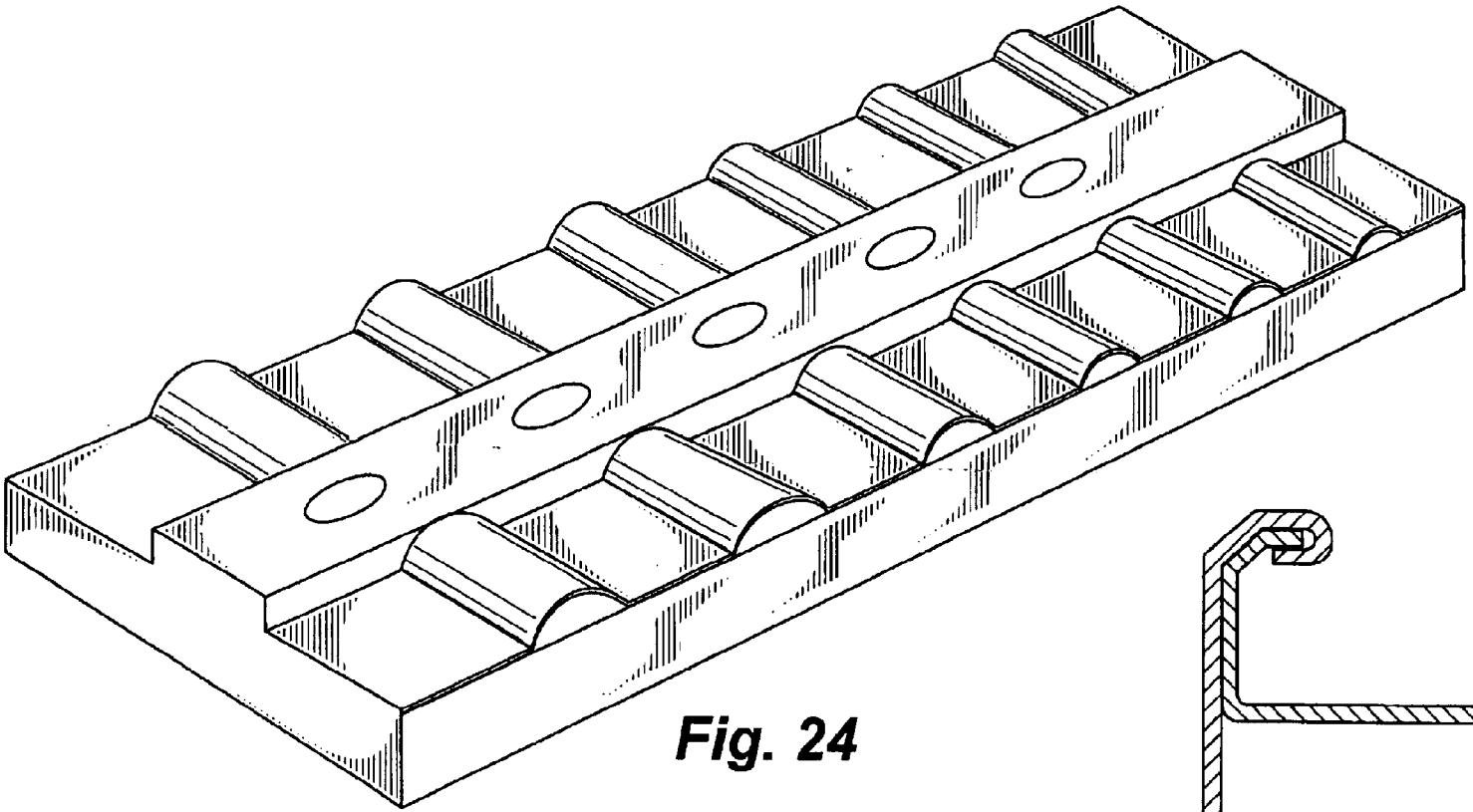
FIG. 24 is a perspective view of the anvil shown in FIG. 23 illustrating its ribbed friction reducing configuration.

With the staple deck properly positioned within the body as shown in FIG. 21, the assembly then passes through another pair of rollers as illustrated in FIG. 22. These rollers function to squeeze the splayed body and inserted staple deck inwardly toward a square or rectangular configuration. In the process, the bowed deck of the staple deck member from the positioning station tends to return to a substantially flat configuration as shown, but the staple deck member still is only loosely positioned within the body. To secure the staple deck firmly within the body, the assembly is passed through a crimping station 51, a preferred embodiment of which is illustrated in FIGS. 23 and 24. At the crimping station, the inner tangs 28 and 29 of the body are bent and crimped upwardly and tightly over and around the edges 16 and 17 of the staple deck 11 to secure the staple deck within the body. More specifically, at the crimping station, a pair of side rollers 61 ad 62 progressively bend the splayed walls of the body 21 and the staple deck 11 inwardly so that the assembly approaches a square or rectangular shape. At the same time, longitudinally aligned pairs of crimping rollers 53 and 54 and a crimping anvil 56 progressively bend or crimp the inner tangs 28 and 29 of the body upwardly as illustrated by the arrows until they engage and securely capture the edges 16 and 17 of the staple deck member 21, thereby securing the staple deck member within the body. As best illustrated in FIG. 24, the crimping anvil gradually increases in thickness from its upstream end to its downstream end for progressively bending the inner tangs of the body upwardly as the assembly moves between the anvil and the successive crimping rollers. In this regard, a series of successively taller ribs are formed along the crimping anvil at the positions of the crimping rollers to reduce friction as the assembly passes through the crimping station. When the assembly leaves the crimping station, the staple deck is captured and held securely in place within the body with its upper edges 16 and 17 crimped and securely held by the inner tangs of the body, as best illustrated in FIG. 25.

Upon leaving the crimping station, the frame member assembly still is slightly splayed or open and not yet completely formed into its final square shape. To square the frame member, it first passes through a set of squaring rollers, such as those illustrated in FIG. 22, that squeeze the sides of the frame member and the sides of the staple deck member inwardly toward a square shape. In this regard, the rollers may be formed to over-bend the frame member beyond a square shape and, because of the natural memory of the metal, it tends to bend back out slightly after leaving the squaring rollers to a substantially square shape as shown in FIG. 25. As the frame member passes through the squaring station and is bent inwardly, the still slightly upwardly bowed deck of the staple deck continues to flatten back to its original planar or flat configuration.

After passing the squaring rollers, the frame member is substantially completely formed. However, in order to assure a consistently sized and accurately square shape, the member preferably is passed through a moving pneumatic shaper (not shown). The pneumatic shaper has internal anvils of the proper shape and size of the desired frame member and elongated hammers that can be driven pneumatically with substantial force against the sides of the frame member and the anvils. The pneumatic shaper preferably is several inches long so that force is applied to the frame member along a substantial length thereof when the hammers are activated. This helps to insure that the metal of the frame member retains its final shape and does not bend or splay back out as a result of the natural memory of the metal. To accomplish this, the pneumatic shaper preferably is mounted on rails and, when activated, rides along with the moving frame member as it exits the roll forming machine to maintain pressure and shaping force on the frame member for a period of time. At the end of this period of time, the hammers are released and the pneumatic shaper is moved by a pneumatic cylinder back to its home position, where it is again activated to shape the next successive section of frame member. In this way, the entire length of the frame member is shaped in successive slightly overlapping sections.

Figure 25:
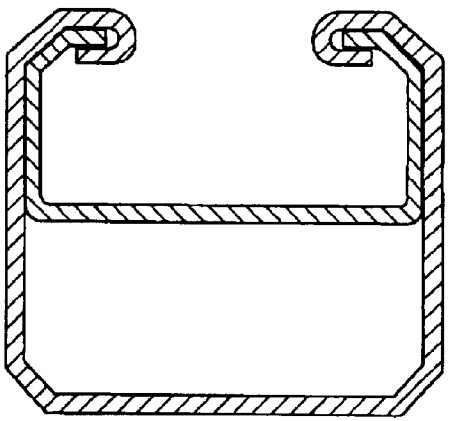
FIG. 25 illustrates in cross-section the final shape of the awning frame member of this invention.

When the frame member leaves the pneumatic shaper, the roll forming process is complete and the frame member takes on its final cross-sectional shape as illustrated in FIG. 25. A moving saw (not shown) is positioned downstream of the roll forming machine and pneumatic shaper and is programmed to cut the roll formed awning frame member into desired lengths depending upon application specific requirements. The frame members can then be used to fabricate awnings in the usual way by welding frame members together to form the skeleton of an awning assembly, covering the frame with fabric, tucking the fabric into the slots of the frame members, and driving staples through the fabric and staple deck.

The inventions have been described herein in terms of preferred embodiments and methodologies that represent the best mode known to the inventors for carrying out the invention. A variety of modifications to the illustrated embodiments might be made by those of skill in the art, however, within the scope of the invention. For instance, rather than securing the staple deck within the body by a crimping process, it might be secured in other ways such as, for example, by spot welding the two pieces together at the end of the roll forming line, or by crimping or punching through the two pieces. In such event, the shapes of the body and staple deck might be different from the specific shapes shown in the attached drawings and photographs to accommodate the particular securing technique used. The metal from which the staple deck and body are formed may be any appropriate metal other than galvanized steel and/or aluminum depending upon application specific requirements. These and other additions, deletions, and modifications might well be implemented, and all are considered to be within the spirit and scope of the invention as set forth in the claims.

What is claimed is:

1. A staple-in awning frame member for receiving cloth material and staples, said frame member comprising:

a generally rectangular body member having a floor, a pair of spaced apart sides extending upwardly from said floor to upper edge portions, and a pair of tabs extending inwardly toward each other from said upper edge portions of said sides, said tabs defining between them a slot that extends along one side of said rectangular body member, said slot for receiving cloth material to be attached to said awning frame member;

a separate staple deck member positioned within said body member and forming a staple deck recessed within said slot for receiving staples, said staple deck member having a deck and a pair of spaced apart side walls extending upwardly from said deck, said side walls being positioned against said sides of said body member for recessing said deck within said slot;

said staple deck member being secured to said body member;

a portion of said body member being crimped around a portion of said staple deck member to secure said staple deck member to said body member; and said staple deck member including a pair of inwardly extending edges crimped beneath said tabs of said body member.

2. A staple-in awning frame member as claimed in claim 1 and wherein said body member further comprises a pair of tangs extending around and crimping said inwardly extending edges of said staple deck member.

* * * * *